US005145599A

United States Patent [19]

Endres et al.

[11] Patent Number: 5,145,599

[45] Date of Patent: Sep. 8, 1992

[54] USE OF CATIONIC NON-SILICATE LAYER COMPOUNDS IN DETERGENTS

[75] Inventors: Helmut Endres, Duesseldorf; Horst Upadek, Ratingen, both of Fed. Rep. of Germany

[73] Assignee: Henkel Kommanditgesellschaft auf Aktien, Duesseldorf-Holthausen, Fed. Rep. of Germany

[21] Appl. No.: 623,947

[22] PCT Filed: May 29, 1989

[86] PCT No.: PCT/EP89/00594

§ 371 Date: Jun. 6, 1990

§ 102(e) Date: Jun. 6, 1990

[87] PCT Pub. No.: WO89/12088

PCT Pub. Date: Dec. 14, 1989

[30] Foreign Application Priority Data

Jun. 6, 1988 [DE] Fed. Rep. of Germany ..... 3819191

[51] Int. Cl.[5] ..... C11D 3/12; C11D 9/18; D06L 1/12

[52] U.S. Cl. ..... 252/174.25; 252/131; 252/DIG. 15; 8/137

[58] Field of Search ..... 106/35; 424/49; 252/174.25, 131, DIG. 15; 8/137

[56] References Cited

U.S. PATENT DOCUMENTS

| | | | |
|---|---|---|---|
| 4,296,094 | 10/1981 | Matsushima | 424/49 |
| 4,871,396 | 10/1989 | Tsujita | 106/35 |

FOREIGN PATENT DOCUMENTS

| | | |
|---|---|---|
| 1265115 | 1/1990 | Canada . |
| 0063631 | 4/1981 | European Pat. Off. . |
| 0206799 | 12/1986 | European Pat. Off. . |
| 0209840 | 1/1987 | European Pat. Off. . |
| 341571 | 10/1985 | Fed. Rep. of Germany . |

OTHER PUBLICATIONS

Chemical Abstracts, vol. 91, Nr. 26 Dec. 10, 1979 (Columbus, Ohio) p. 305. Abstract No. 216265s.

*Primary Examiner*—Paul Liberman
*Assistant Examiner*—Erin M. Higgins
*Attorney, Agent, or Firm*—Ernest G. Szoke; Wayne C. Jaeschke; Real J. Grandmaison

[57] ABSTRACT

Cationic non-silicate layer compounds corresponding to general formula (I)

$$Mg_xAl(OH)_yA_z \cdot NH_2O \quad (I)$$

in which A represents an equivalent of a non-silicate anion, x has a value of from 1 to 5, y>z and (y+Z)=2X+3 and n is a number of 0 to 10, are used in phosphate-reduced detergents for reducing fabric incrustation.

8 Claims, No Drawings

USE OF CATIONIC NON-SILICATE LAYER COMPOUNDS IN DETERGENTS

This invention relates to the use of cationic non-silicate layer compounds in detergent compositions and, in particular, in phosphate-reduced zeolite-based detergents.

In practice, combinations of zeolite A and so-called co-builders, such as polycarboxylates for example, have been successfully used in attempts completely to replace the ecologically undesirable sodium tripolyphosphate in detergent compositions. However, almost all the known polycarboxylates presently used for detergent compositions show poor biodegradable. Inorganic layer-like compounds have been proposed as alternative builder constituents which, ecologically, have no effect on the environment. For example, synthetic, finely divided, water-insoluble layer silicates having a smectite-like crystal phase are described in EP-A 0 209 840 while crystalline, layer-form sodium silicates are described in DE-OS 34 13 571. These layer compounds are all layer silicates.

The use of non-silicate layer compounds as builder component in detergent compositions is unknown. EP-A 0 206 799 describes the use of mixed metal hydroxides solely for preventing dye transfer in washing processes.

In the context of the present invention, "phosphate-reduced" means that detergent compositions contain at most 30% by weight sodium tripolyphosphate, but may also be completely phosphate-free.

The object of the present invention is to provide new phosphate-reduced detergent compositions and to reduce fabric incrustation in standard washing processes.

The objects stated above are achieved by the use of cationic, non-silicate layer compounds as a separate addition to zeolite-containing, phosphate-reduced and, in particular, phosphate-free detergent compositions or as an integral detergent constituent. It has been found in this regard that fabric incrustation is clearly reduced so that the invention makes a significant contribution towards the formulation of environmentally compatible builder systems.

The present invention relates to the use of cationic, non-silicate layer compounds corresponding to general formula (I)

$$Mg_xAl(OH)_yA_znH_2O \quad (I)$$

in which A represents an equivalent of a non-silicate anion and the conditions $1<x<5$, $y>z$, $(y+z)=2x+3$, $0<n<10$ apply, in phosphate-reduced detergent compositions, the cationic layer compounds belonging to the structure type of hydrotalcite with a lattice distance for the most intensive line in the X-ray diffractogram of from 7.4 to 8 Å for the product dried at 110° C.

In the context of the invention, cationic layer compounds are understood to be solids of which the structure is derived from the layer-form magnesium hydroxide, brucite, by the partial replacement of the divalent metal ions by trivalent metal ions. The resulting positive excess charge of the metal hydroxide layers is compensated by exchangeable anions between the layers. Hydrotalcite may be used as a model substance for this class of solids.

Hydrotalcite is a substance occurring in nature as a mineral having the approximate composition $$Mg_6Al_2(OH)_{16}CO_3 \cdot 4H_2O$$

the ratio of Mg to Al and, hence, the carbonate content being variable within relatively wide limits. The carbonate may be replaced by other anions. By contrast, the substance is characterized by its layer structure with the layer sequence ABAB . . . , where A is a positively charged triple layer of hydroxyl ions, metal cations and more hydroxyl ions. B is an intermediate layer of anions and water of crystallization. This layer structure is shown up in an X-ray powder diagram which may be used for characterization. Thus, ASTM Card No. 14-191 gives the lines for the lattice plane spacings d=7.69, 3.88, 2.58, 2.30, 1.96, 1.53 and 1.50 Å as the most intensive X-ray interferences. The spacing 7.69 Å is the basic repetition period of the layers (=layer spacing) of the substance which normally contains water of crystallization. More rigorous drying at elevated temperature (120° to 200° C. at normal pressure) leads to reduced layer spacings through release of the water of crystallization.

The crystal structure of natural hydrotalcite was determined radiographically by Allmann and Jepsen (N. Jahrb. Mineral. Monatsh. 1969, pages 544–551). The range of variation of the Mg to Al ratio and its influence on the repetition period of the layers was investigated, for example, by Gastuche, Brown and Mortland (Clay Miner. 7 (1967), pages 177–192). Possible processes for the commercial production of synthetic hydrotalcite and its use as an agent for binding stomach acid were described in 1967 by Kyowa Chemical Industry Co., Tokyo (DE-OS 15 92 126). Apart from neutralizing stomach acid, hydrotalcite may generally be used for binding acidic components, for example impurities from catalytic processes (DE-OS 27 19 024) or unwanted dyes (DE-OS 29 29 991). Further potential applications are in the field of corrosion prevention (DE-OS 31 28 716), the stabilization of plastics, particularly PVC (DE-PS 30 19 632), in wastewater treatment (JP-PS 79 24 993, JP-PS 58 214 388) and in the production of colored pigments (JP-PS 81 98 265).

The incorporation of carbonate ions as intermediate layer anions is particularly preferred. Hydrotalcite-like solids containing other anions may be obtained by using a soluble salt of another acid instead of sodium carbonate in the production process or by removing the carbonate from the carbonate-containing product in the form of $CO_2$ by reaction with weak acids. The exchange of the anions is shown up in the X-ray diffractogram by a change in the layer spacings (T. Reichle, Chemtech. Jan. 1986, pages 58–63).

Another embodiment of the present invention is characterized by the use of cationic non-silicate layer compounds in which A in general formula (I) represents an equivalent of a carbonate ion.

Another preferred embodiment of the present invention is characterized by the use of cationic non-silicate layer compounds corresponding to general formula (I) in a quantity of from 1 to 15% by weight, based on the detergent composition. The use of 2 to 10% by weight of the cationic non-silicate layer compounds, based on the detergent composition, is particularly preferred.

Although, in principle, the phosphate content, based on tripolyphosphate, is not critical in the context of the present invention, the phosphate content expressed as sodium tripolyphosphate is less than 30% by weight in another preferred embodiment of the invention.

Another preferred embodiment of the invention is characterized by the use of cationic non-silicate layer compounds in phosphate-free detergent compositions.

It is particularly preferred to use cationic non-silicate layer compounds where the detergent compositions contain from 10 to 30% zeolite A and from 1 to 15% of the cationic non-silicate layer compounds.

The layer compounds to be used in accordance with the invention may be incorporated by conventional methods for the production of detergents, for example by hot spraying together with other detergent components, by granulation together with solid and/or liquid detergent components and/ or by subsequent application to solid detergent components (for example spray-dried powder, granulate, zeolite, layer silicate).

In addition to cationic layer compounds, detergent compositions according to the invention may contain other builder salts, builders, surfactants, soaps, non-surfactant-like foam inhibitors and soil suspending agents.

The builder components which may be present in the detergents according to the invention are described in detail hereinafter:

Suitable organic and inorganic builder salts are salts showing a mildly acidic, neutral or alkaline reaction, particularly alkali salts which are capable of precipitating or complexing calcium ions. Of the inorganic salts, the water-soluble alkali metaphosphates or alkali polyphosphates, particularly pentasodium triphosphate, are of particular importance alongside the alkali orthophosphates and alkali pyrophosphates. These phosphates may be completely or partly replaced by organic complexing agents for calcium ions, including compounds of the aminopolycarboxylic acid type, such as for example nitrilotriacetic acid (NTA), ethylenediamine tetraacetic acid, diethylenetriamine pentaacetic acid and higher homologs. Suitable phosphorus-containing organic complexing agents are the water-soluble salts of alkane phosphonic acids, amino- and hydroxyalkane phosphonic acids and phosphonopolycarboxylic acids, such as for example methane diphosphonic acid, dimethylaminomethane-1,1-diphosphonic acids, aminotrimethylene triphosphonic acid, 1-hydroxyethane-1,1-diphosphonic acid, 1-phosphonoethane-1,2-dicarboxylicacid,2-phosphonobutane-1,2,4tricarboxylic acid.

Among the organic builders, the nitrogen- and phosphorus-free polycarboxylic acids which form complex salts with calcium ions, including polymers containing carboxyl groups, are of particular importance. Suitable polycarboxylic acids of this type are, for example, citric acid, tartaric acid, benzenehexacarboxylic acid and tetrahydrofuran tetracarboxylic acid. Polycarboxylic acids containing ether groups, such as 2,2'-hydroxydisuccinic acid, are also suitable as are polyfunctional alcohols or hydroxycarboxylic acids completely or partly etherified with glycolic acid, for example bis-carboxymethyl ethylene glycol, carboxymethyl hydroxysuccinic acid, carboxymethyl tartronic acid and carboxymethylated or oxidized polysaccharides. Polymeric carboxylic acids having a molecular weight in the range from 350 to approximately 1,500,000 in the form of water-soluble salts are also suitable. Particularly preferred polymeric polycarboxylates have a molecular weight in the range from 500 to 175,000 and more especially in the range from 10,000 to 100,000. These compounds include, for example, polyacrylic acid, polyhydroxyacrylic acid, polymaleic acid and copolymers of the corresponding monomeric carboxylic acids with one another or with ethylenically unsaturated compounds, such as vinyl methyl ether. Water-soluble salts of polyglyoxylic acid are also suitable.

Suitable water-insoluble inorganic builders are the finely divided, synthetic sodium alumosilicates of the zeolite A type containing bound water which are described in detail as phosphate substitutes for detergents and cleaning preparations in DE-OS 24 12 837.

The cation-exchanging sodium alumosilicates are used in the usual hydrated, finely crystalline form, i.e. they contain hardly any particles larger than 30 μm and, preferably to an extent of at least 80%, consist of particles smaller than 10 μm in size. Their calcium binding power, as determined in accordance with DE-OS 24 12 837, is in the range from 100 to 200 mg CaO/g. Zeolite NaA is particularly suitable, although zeolite NaX and mixtures of NaA and NaX may also be used.

Suitable inorganic, non-complexing salts are the alkali salts—also known as "washing alkalis"—of the bicarbonates, carbonates, borates, sulfates and silicates. Of the alkali silicates, the sodium silicates in which the ratio of $Na_2O$ to $SiO_2$ is from 1:1 to 1:3.5 are particularly preferred.

Other builders which are generally used in liquid detergents by virtue of their hydrotropic properties are the salts of non-capillary-active $C_{2-9}$ sulfonic acids, carboxylic acids and sulfocarboxylic acids, for example the alkali salts of alkane, benzene, toluene, xylene or cumene sulfonic acids, sulfobenzoic acid, sulfohthalic acid, sulfoacetic acid, sulfosuccinic acid and the salts of acetic acid or lactic acid. Acetamide and ureas are also suitable solubilizers.

Surfactants which may be present as further components in the detergents according to the invention contain at least one hydrophobic organic radical and a water-solubilizing anionic, zwitter-ionic or nonionic group in the molecule. The hydrophobic radical is generally an aliphatic hydrocarbon radical containing 8 to 26, preferably 10 to 22 and more preferably 12 to 18 carbon atoms or an alkyl aromatic radical containing 6 to 18 and preferably 8 to 16 aliphatic carbon atoms.

Suitable anionic surfactants are, for example, soaps of natural or synthetic, preferably saturated, fatty acids and, optionally, of resinic or naphthenic acids. Suitable synthetic ionic surfactants are those of the sulfate, sulfonate and synthetic carboxylate type.

Suitable surfactacts of the sulfonate type are alkyl benzenesulfonates ($C_{9-15}$ alkyl), olefin sulfonates, i.e. mixtures of alkene and hydroxyalkane sulfonates and also disulfonates, of the type obtained for example from $C_{12-18}$ monoolefins containing a terminal or internal double bond by sulfonation with gaseous sulfur trioxide and subsequent alkaline or acidic hydrolysis of the sulfonation products.

Other suitable sulfonate surfactants are the alkane sulfonates obtainable from $C_{12-18}$ alkanes by sulfochlorination or sulfoxidation and subsequent hydrolysis or neutralization or by addition of bisulfites onto olefins and also the esters of α-sulfofatty acids, for example the α-sulfonated methyl or ethyl esters of hydrogenated coconut oil, palm kernel oil or tallow fatty acids.

Suitable surfactants of the sulfate type are sulfuric acid monoesters of primary alcohols of natural and synthetic origin, i.e. of fatty alcohols, such as for example coconut oil fatty alcohols, tallow fatty alcohols, oleyl alcohol, lauryl, myristyl, palmityl or stearyl alcohol, or the $C_{10-20}$ oxoalcohols and secondary alcohols having the same chain length. Sulfuric acid monoesters of aliphatic primary alcohols ethoxylated with 1 to 6 mol ethylene oxide and ethoxylated secondary alcohols and alkylphenols are also suitable. Sulfatized fatty acid alcohol amides and sulfatized fatty acid monoglycerides may also be used.

Other suitable anionic surfactants are the fatty acid esters and amides of hydroxy- or aminocarboxylic acids or sulfonic acids such as, for example, fatty acid sarcosides, glycolates, lactates, taurides or isethionates.

The anionic surfactants may be present in the form of their sodium, potassium and ammonium salts and as soluble salts of organic bases, such as mono-, di- or triethanolamine.

Adducts of 1 to 40 mol and preferably 2 to 20 mol ethylene oxide with 1 mol of a compound essentially containing 10 to 20 carbon atoms from the group consisting of alcohols, alkylphenols and fatty acids may be used as nonionic surfactants. Particularly important adducts are those of 8 to 20 mol ethylene oxide with primary alcohols for example with coconut or tallow fatty alcohols, With oleyl alcohol, with oxoalcohols, or with secondary alcohols containing 8 to 18 and preferably 12 to 18 carbon atoms and with mono- or dialkylphenols containing 6 to 14 carbon atoms in the alkyl groups. In addition to these water-soluble nonionics, however, it is also possible to use water-insoluble or substantially water-insoluble polyglycol ethers containing 2 to 7 ethylene glycol ether groups in the molecule are also of interest, particularly where they are used together with water-soluble nonionic or anionic surfactants.

Other suitable nonionic surfactants are the water-soluble adducts containing—20 to 250 ethylene glycol ether groups and 10 to 100 propylene glycol ether groups—of ethylene oxide with polypropylene glycol, alkylenediamine polypropylene glycol and with alkyl polypropylene glycols containing 1 to 10 carbon atoms in the alkyl chain, in which the polypropylene glycol chain functions as the hydrophobic radical. It is also possible to use nonionic surfactants of the amine oxide or sulfoxide type, for example the compounds N-coconut alkyl-N,N-dimethylamine oxide, N-hexadecyl-N,N-bis-(2,3-dihydroxypropyl)-amine oxide, N-tallow alkyl-N,N-dihydroxyethylamine oxide. N-alkoxylated fatty acid amides do not count as nonionic surfactants in the context of the invention.

The zwitter-ionic surfactants optionally used are preferably derivatives of aliphatic quaternary ammonium compounds, in which one of the aliphatic radicals consists of a $C_{8-18}$ radical and another contains an anionic, water-solubilizing carboxy, sulfo or sulfato group. Typical representatives of such surface-active betaines are, for example, the compounds3-(N-hexadecyl-N,N-dimethylammonio) -propane sulfonate; 3-(N-tallow alkyl-N,N-dimethylammonio)2-hydroxypropane sulfonate; 3-(N-hexadecyl-N,N-bis -(2-hydroxyethyl)-ammonio)-2-hydroxypropyl sulfate; 3 -(N-coconut alkyl-N,N-bis-(2,3-dihydroxypropyl)-ammonio)-propane sulfonate;N-tetradecyl-N,N-dimethylammonioacetate; N-hexadecyl-N,N-bis-(2,3-dihydroxypropyl)-ammonioacetate.

Reduced foaming power, which is desirable where the detergents are used in machines, is obtained, for example, by the co-use of soaps. With soaps, foam suppression increases with the degree of saturation and the C number of the fatty acid ester; accordingly, soaps of saturated and unsaturated $C_{12-24}$ fatty acids are particularly suitable as foam inhibitors.

The non-surfactant-like foam inhibitors are generally water-insoluble, mostly aliphatic $C_{8-22}$ compounds. Suitable non-surfactant-like foam inhibitors are, for example, the N-alkylaminotriazines, i.e. reaction products of 1 mol cyanuric chloride with 2 to 3 mol of a mono- or dialkylamine essentially containing 8 to 18 carbon atoms in the alkyl group. Other suitable non-surfactant-like foam inhibitors are propoxylated and/or butoxylated aminotriazines, for example the reaction products of 1 mol melamine with 5 to 10 mol propylene oxide and, in addition, 10 to 50 mol butylene oxide and also aliphatic $C_{18-40}$ ketones, such as for example stearone, fatty ketones of hydrogenated train oil fatty acid or tallow fatty acid and also paraffins and haloparaffins having melting points below 100° C. and silicone oil emulsions based on polymeric organosilicon compounds.

The detergents according to the invention may additionally contain bleaches and bleach activators. Among the compounds yielding $H_2O_2$ in water, which serve as bleaches, sodium perborate tetrahydrate ($NaBO_2 \cdot H_2O_2 \cdot 3H_2O$) and the monohydrate ($NaBO_2 \cdot H_2O_2$) are of particular importance. However, it is also possible to use other $H_2O_2$-yielding borates, for example perborax $Na_2B_4O_7 \cdot 4H_2O_2$. These comborates pounds may be partly or completely replaced by other active oxygen carriers, more especially by peroxypyrophosphates, citrate perhydrates, urea/$H_2O_2$ or melamine/$H_2O_2$ compounds, and by $H_2O_2$-yielding per acid salts such as, for example, caroates ($KHSO_3$), perbenzoates or peroxyphthalates.

Since the detergents according to the invention are intended in particular for washing at low washing temperatures, activator-containing bleach components are preferably incorporated in the detergents. Suitable activators for per compounds which yield $H_2O_2$ in water are certain N-acyl or O-acyl compounds which form organic per acids. Suitable compounds are inter alia N-diacylated and N,N'-tetraacylated amines such as, for example, N,N,N',N,-tetraacetyl methylenediamine or ethylenediamine or tetraacetyl glycoluril.

The detergent compositions according to the invention may also contain soil suspending agents which keep the soil detached from the fibers suspended in the wash liquor and thus prevent redeposition. Suitable soil suspending agents are generally organic water-soluble colloids, such as for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. It is also possible to use soluble starch preparations and other starch products than those mentioned above, such as for example degraded starch, aldehyde starches, etc. Polyvinylpyrrolidone may also be used.

EXAMPLES

The magnesium aluminium hydroxycarbonate (hydrotalcite) of hydrotalcite-like structure used for Example 1 was prepared in accordance with DE-OS 15 92 126 by adding a solution of 6.4 kg $Mg(NO_3)_2 \cdot 6H_2O$ and 4.7 kg $Al(NO_3)_3 \cdot 6H_2O$ in 17.5 kg deionized water to a solution of 7 kg 50% by weight sodium hydroxide and 2.5 kg sodium carbonate in 25 kg deionized water with stirring over a period of 4 hours at room temperature. The reaction mixture was then stirred for 18 hours at 65° C., the white precipitate was removed by centrifuging and washed with approximately 60 l deionized water. The product was then dried in vacuo at 110° C.

The product shows the X-ray diffractogram typical of hydrotalcite with the interferences for lattice plane spacings d=7.68, 3.82, 2.67 (reflex with shoulder), 2.32 (broad), 1.97 (broad), 1.52 and 1.50 Å. The analytically determined ratio of Mg to Al was 2.08 to 1.

In the following Examples, EO stands for ethylene oxide.

COMPARISON EXAMPLE 1

Washing tests were carried out in a domestic drum-type washing machine. To this end, the phosphate-free, zeolite-containing basic detergent of the following composition was first prepared:

| Basic detergent A | % |
|---|---|
| Alkyl benzensuulfonate | 8.0 |
| Tallow fatty alcohol-5 EO | 2.4 |
| Tallow fatty alcohol-14 EO | 0.5 |
| $C_{12-18}$ fatty alcohol-5 EO + $C_{12-14}$ fatty alcohol-3 EO mixture | 1.5 |
| $C_{16-22}$ fatty acid Na salt | 8.0 |
| Zeolite A | 25.0 |
| Waterglass, $Na_2O:SiO_2$ ratio 3.35 | 1.5 |
| Sodium carbonate | 0.6 |
| Na ethylenediamine tetramethylene phosphonate | 0.1 |
| Cellulose ether mixture | 0.8 |
| Sodiumperborate tetrahydrate | 22.5 |
| Tetraacetyl ethylenediamine | 1.0 |
| Protease | 0.2 + |
| Optical brightener, perfume | 0.3 |
| Salts, water and $Na_2SO_4$ | balance |

104 g of basic detergent A was added to the prewash and 144 g to the main wash of a 90° C. boil-wash program (water hardness approx. 16° Gh). A 3.5 kg load of normally soiled washing were washed 19 times in the presence of cotton fabrics. After 19 washes, the cotton fabric was incinerated. The results are shown in Table 1.

COMPARISON EXAMPLE 2

Washing tests were carried out in a domestic drum-type washing machine using a detergent of the following composition:

| Detergent composition B | % |
|---|---|
| Synthetic layer silicate according to EP 0 209 840 | 5.0 |
| Alkyl benzenesulfonate | 8.0 |
| Tallow fatty alcohol-5 EO | 2.4 |
| Tallow fatty alcohol-14 EO | 0.5 |
| $C_{12-18}$ fatty alcohol-5 EO + $C_{12-14}$ fatty alcohol-3 EO mixture | 1.5 |
| $C_{16-22}$ fatty acid Na salt | 8.0 |
| Zeolite A | 25.0 |
| Waterglass, $Na_2O:SiO_2$ ratio 3.35 | 1.5 |
| Sodium carbonate | 0.6 |
| Na ethylenediamine tetramethylene phosphonate | 0.1 |
| Cellulose ether mixture | 0.8 |
| Sodiumperborate tetrahydrate | 22.5 |
| Tetraacetyl ethylenediamine | 1.0 |
| Protease | 0.2 + |
| Optical brightener, perfurme | 0.3 |
| Salts, water and $Na_2SO_4$ | balance |

As with basic detergent A, 104 g of detergent B was introduced into the prewash and 144 g into the main wash of a 90° C. boil-wash program (water hardness approx. 16° GH). A 3.5 kg load of normally soiled washing were washed 19 times in the presence of cotton fabrics. After 19 washes, the cotton fabric was incinerated. The results are shown in Table 1.

EXAMPLE 1

Washing tests were carried out in a domestic drum-type washing machine using a detergent having the following composition:

| Detergent Composition C | % |
|---|---|
| Hydrotalcite | 5.0 |
| Alkyl benzenesulfonate | 8.0 |
| Tallow fatty alcohol-5 EO | 2.4 |
| Tallow fatty alcohol-14 EO | 0.5 |
| $C_{12-18}$ fatty alcohol-5 EO + $C_{12-14}$ fatty alcohol-3 EO mixture | 1.5 |
| $C_{16-22}$ fatty acid Na salt | 8.0 |
| Zeolite A | 25.0 |
| Waterglass, $Na_2O:SiO_2$ ratio 3.35 | 1.5 |
| Sodiumcarbonate | 0.6 |
| Na ethylenediamine tetramethylene phosphonate | 0.1 |
| Cellulose ether mixture | 0.8 |
| Sodiumperborate tetrahydrate | 22.5 |
| Tetraacetyl ethylenediamine | 1.0 |
| Protease | 0.2 + |
| Optical brightener, perfurme | 0.3 |
| Salts, water and $Na_2SO_4$ | balance |

As described in the Comparison Examples, 104 g detergent C was introduced into the prewash and 144 g into the main wash of a 90° C. boil wash program (water hardness approx. 16 Gh). A 3.5 kg load of normally soiled washing were washed 19 times in the presence of cotton fabrics. After 19 washes, the cotton fabric was incinerated.

TABLE 1

| Example (detergent composition) | % Ash |
|---|---|
| Comp. 1 (A) | 1.21 |
| Comp. 2 (B) | 0.99 |
| 1 (C) | 0.84 |

The results in Table 1 show that the use of cationic non-silicate layer compounds of the hydrotalcite type in accordance with the invention in the detergent composition according to the invention leads to a reduction in fabric incrustation for the same detergency.

We claim:

1. The process of reducing the incrustation of laundered fabrics, comprising laundering fabrics with a laundry detergent composition containing from about 1 to about 15% by weight, based on the weight of said composition, of a cationic non-silicate layer compound corresponding to formula (I)

$$Mg_xAl(OH)_yA_znH_2O \quad (I)$$

wherein A represents an equivalent of a non-silicate anion and $1<X<5$, $y>z$, $(y+z)=2x+3$, $0<n<10$, said cationic non-silicate layer compound having a hydrotalcite structure with a lattice distance for the most intensive line in the X-ray diffractogram of from about 7.4 to about 8 Å when dried at 110° C.

2. The process as in claim 1 wherein A represents an equivalent of a carbonate ion.

3. The process as in claim 1 wherein said layer compound is present in a quantity of from about 2 to about 10% by weight, based on the weight of said detergent composition.

4. The process as in claim 1 wherein said detergent composition contains up to about 30% by weight of a phosphate compound, based on the weight of said detergent composition.

5. The process as in claim 1 wherein said detergent composition is essentially free of a phosphate compound.

6. The process as in claim 1 wherein said detergent composition contains from about 10 to about 30% by weight of zeolite A, based on the weight of said detergent composition.

7. The process as in claim 1 wherein said detergent composition contains a builder component, surfactant, soap, foam inhibitor, and soil-suspending agent.

8. The process of reducing the incrustation of laundered fabrics, comprising laundering fabrics with a laundry detergent composition containing from about 10 to about 30% by weight of zeolite A and from about 1 to about 15% by weight, based on the weight of said composition, of a cationic non-silicate layer compound corresponding to formula (I)

$$Mg_xAl(OH)_yA_z \cdot nH_2O \quad (I)$$

wherein A represents an equivalent of a non-silicate anion and $1<X<5$, $y>z$, $(y+z)=2x+3$, $0<n<10$, said cationic non-silicate layer compound having a hydrotalcite structure with a lattice distance for the most intensive line in the X-ray diffractogram of from about 7.4 to about 8 Å when dried at 110° C.

* * * * *